US007902117B2

(12) United States Patent
Mathur et al.

(10) Patent No.: US 7,902,117 B2
(45) Date of Patent: Mar. 8, 2011

(54) THERMAL PAPER

(76) Inventors: Sharad Mathur, Macon, GA (US); Ivan Petrovic, Princeton, NJ (US); David Lewis, Appleton, WI (US); Xiaolin D. Yang, Edison, NJ (US); Ernest M. Finch, Hopewell Junction, NY (US)

( * ) Notice: Subject to any disclaimer, the term of this patent is extended or adjusted under 35 U.S.C. 154(b) by 0 days.

(21) Appl. No.: 11/291,224

(22) Filed: Dec. 1, 2005

(65) Prior Publication Data

US 2006/0122059 A1 Jun. 8, 2006

Related U.S. Application Data

(60) Provisional application No. 60/633,143, filed on Dec. 3, 2004.

(51) Int. Cl.
*B41M 5/20* (2006.01)
*B41M 5/24* (2006.01)

(52) U.S. Cl. ..... 503/200

(58) Field of Classification Search ..... 503/200, 503/226

See application file for complete search history.

(56) References Cited

U.S. PATENT DOCUMENTS

| | | | | | |
|---|---|---|---|---|---|
| 4,219,220 | A | * | 8/1980 | Oda et al. | 503/209 |
| 4,533,930 | A | * | 8/1985 | Shioi et al. | 503/211 |
| 4,822,771 | A | * | 4/1989 | Igarashi | 503/226 |
| 4,853,256 | A | | 8/1989 | Obringer et al. | 427/152 |
| 4,888,321 | A | * | 12/1989 | Kawakami et al. | 503/208 |
| 4,923,845 | A | | 5/1990 | Koike et al. | |
| 5,006,863 | A | | 4/1991 | Talvalkar | 346/1.1 |
| 5,045,523 | A | * | 9/1991 | Funae et al. | 503/207 |
| 5,064,806 | A | * | 11/1991 | Torii et al. | 503/200 |
| 5,091,357 | A | | 2/1992 | Kosaka | |
| 5,407,891 | A | | 4/1995 | Matsushita et al. | 503/204 |
| 5,786,839 | A | | 7/1998 | Itoh | 347/211 |
| 5,851,655 | A | * | 12/1998 | Tokiyoshi et al. | 428/330 |
| 6,071,851 | A | | 6/2000 | Wakamatsu | |
| 6,566,301 | B2 | | 5/2003 | Mathiaparanam et al. | 503/209 |
| 6,582,734 | B1 | * | 6/2003 | Wei et al. | 424/665 |
| 6,586,364 | B2 | * | 7/2003 | Kubota et al. | 503/215 |
| 6,656,880 | B2 | * | 12/2003 | Aono | 503/207 |
| 6,667,275 | B2 | * | 12/2003 | Sano et al. | 503/200 |
| 6,784,136 | B2 | * | 8/2004 | Iwasaki et al. | 503/217 |
| 6,800,588 | B2 | * | 10/2004 | Iwasaki et al. | 503/226 |

FOREIGN PATENT DOCUMENTS

| | | |
|---|---|---|
| JP | 07010623 | 10/1987 |
| JP | 02-092581 A | 4/1990 |

OTHER PUBLICATIONS

AZoM.com, Silica—Colloidal Silica (Silicon Dioxide), AZoM—The A to Z of Materials and AZojomo (2000-2006), available at http://www.azom.com/details.asp?ArticleID=1385.*

International Search Report PCT/US2005/043496.

* cited by examiner

*Primary Examiner* — Mark Ruthkosky
*Assistant Examiner* — David J Joy
(74) *Attorney, Agent, or Firm* — Bernard Lau

(57) ABSTRACT

The present invention provides a thermal paper composite precursor comprising (a) a substrate layer; and (b) a base layer positioned on the substrate layer, the base layer comprising a binder and at least one porosity improver wherein the thermal paper composite precursor has a thermal effusivity that is at least about 2% less than the thermal effusivity of porosity improver-less thermal paper composite precursor. The thermal paper composite precursor is useful in making thermal paper composite.

11 Claims, 3 Drawing Sheets

THERMAL PAPER

This patent application claims the priority of pending U.S. patent application Ser. No. 60/633,143 filed Dec. 3, 2004, and incorporates it in its entirety herein by reference.

FIELD OF THE INVENTION

The present invention generally relates to thermal paper with improved thermal properties. In particular, the present invention relates to thermal paper containing a base layer that provides improved thermal insulating characteristics that in turn provide numerous advantages to the thermal paper.

BACKGROUND OF THE INVENTION

Thermal printing systems use a thermal print element energized to heat specific and precise areas of a heat sensitive paper to provide an image of readable characters or graphics on the heat sensitive paper. The heat sensitive paper, also known as thermal paper, includes material(s) which is reactive to applied heat. The thermal paper is a self-contained system, referred to as direct thermal, wherein ink need not be applied. This is advantageous in that providing ink or a marking material to the writing instrument is not necessary.

Thermal printing systems typically include point of sale (POS) devices, facsimile machines, adding machines, automated teller machines (ATMs), credit card machines, gas pump machines, electronic blackboards, and the like. While the aforementioned thermal printing systems are known and employed extensively in some fields, further exploitation is possible if image quality on thermal paper can be improved.

Some thermal papers produced by thermal printing systems suffer from low resolution of written image, limited time duration of an image (fading), delicacy of thermal paper before printing (increasing care when handling, shipping, and storing), and the like.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Rather, the sole purpose of this summary is to present some concepts of the invention in a simplified form as a prelude to the more detailed description that is presented hereinafter.

The present invention provides a thermal paper composite precursor comprising (a) a substrate layer; and (b) a base layer positioned on the substrate layer, the base layer comprising a binder and at least one porosity improver wherein the thermal paper composite precursor has a thermal effusivity that is at least about 2% less than the thermal effusivity of porosity improver-less thermal paper composite precursor.

The present invention provides thermal paper containing a base layer that provides thermal insulating properties which mitigates heat transfer from the active layer to the substrate layer. Mitigating heat transfer results in printing images of improved quality. The thermal insulating properties of the base layer also permit the use of decreased amounts of active layer materials, which are typically relatively expensive compared to other components of the thermal paper.

One aspect of the invention relates to thermal paper containing a substrate layer; an active layer containing image forming components; and a base layer positioned between the substrate layer and the active layer, the base layer containing a binder and a porosity improver having a specified thermal effusivity. The specified thermal effusivity dictates, in part, the improved thermal insulating properties of the thermal paper. The base layer need not contain image forming components, which are included in the active layer.

Another aspect of the invention relates to making thermal paper involving forming a base layer containing a binder and a porosity improver to improve thermal effusivity over a substrate layer; and forming an active layer containing image forming components over the base layer.

Yet another aspect of the invention relates to printing thermal paper containing a substrate layer, an active layer, and a base layer positioned between the substrate layer and the active layer, the base layer containing a binder and a porosity improver, involving applying localized heat using a thermal paper printer in the pattern of a desired image to form the desired image in the thermal paper.

To the accomplishment of the foregoing and related ends, the invention comprises the features hereinafter fully described and particularly pointed out in the claims. The following description and the annexed drawings set forth in detail certain illustrative aspects and implementations of the invention. These are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1:
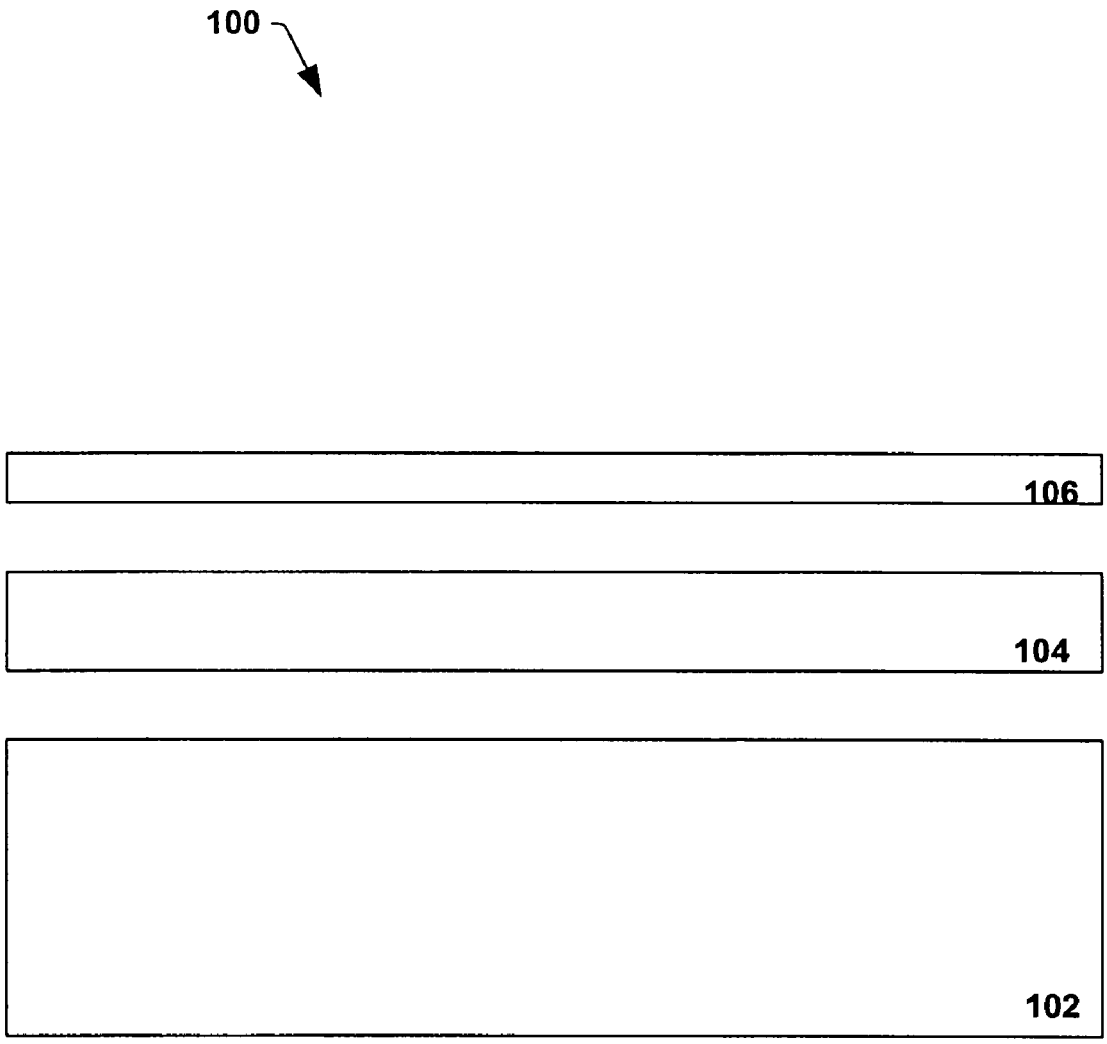
FIG. 1 is a cross sectional illustration of thermal paper in accordance with an aspect of the subject invention.

The phrase "porosity improver-less thermal paper composite precursor" means a thermal paper composite precursor that does not contain at least one porosity improver in the base layer thereof.

Generally speaking, thermal paper is coated with a base layer and a colorless formula (the active layer) which subsequently develops an image by the application of heat. When passing through an imaging device, precise measures of heat applied by a print head cause a reaction that creates an image (typically black or color) on the thermal paper. The base layer of the subject invention is made so that it possesses a thermal effusivity that improves the quality and/or efficiency of thermal paper printing.

Direct thermal imaging technology of the subject invention may employ a print head where heat generated induces a release of ink in the active layer of thermal paper. This is also known as direct thermal imaging technology and uses a thermal paper containing ink in a substantially colorless form in an active coating on the surface. Heat generated in the print head element transfers to the thermal paper and activates the ink system to develop an image. Thermal imaging technology may also employ a transfer ribbon in addition to the thermal paper. In this case, heat generated in a print head is transferred to a plastic ribbon, which in turn releases ink for deposition on the thermal paper. This is known as thermal transfer imaging as opposed to the subject of direct thermal imaging.

Thermal paper typically has at least three layers: a substrate layer, an active layer for forming an image, and a base layer between the substrate layer and active layer. Thermal paper may optionally have one or more additional layers including a top coating layer (sometimes referred to as a protective layer) over the active layer, a backside barrier adjacent the substrate layer, image enhancing layers, or any other suitable layer to enhance performance and/or handling.

The substrate layer is generally in sheet form. That is, the substrate layer is in the form of pages, webs, ribbons, tapes, belts, films, cards and the like. Sheet form indicates that the substrate layer has two large surface dimensions and a comparatively small thickness dimension. The substrate layer can be any of opaque, transparent, translucent, colored, and non-colored (white). Examples of substrate layer materials include paper, filamentous synthetic materials, and synthetic films such as cellophane and synthetic polymeric sheets (the synthetic films can be cast, extruded, or otherwise formed). In this sense, the word paper in the term thermal paper is not inherently limiting.

The substrate layer is of sufficient basis weight to support at least an active layer and base layer, and optionally of sufficient basis weight to further support additional, optional layers such as a top coating layer and/or a backside barrier. In one embodiment, the substrate layer has a basis weight of about 14 $g/m^2$ or more and about 50 $g/m^2$ or less. In another embodiment, the substrate layer has a basis weight of about 30 $g/m^2$ or more and about 148 $g/m^2$ or less. In yet another embodiment, the substrate layer has a thickness of about 40 microns or more and about 130 microns or less. In still yet another embodiment, the substrate layer has a thickness of about 20 microns or more and about 80 microns or less.

The active layer contains image forming components that become visible to the human eye or a machine reader after exposure to localized heat. The active layer contains one or more of a dye, chromogenic material, developer, inert pigment, antioxidants, lubricants, polymeric binder, sensitizer, stabilizer, wetting agents, and waxes. The active layer is sometimes referred to as a reactive or thermal layer. The components of the active layer are typically uniformly distributed throughout the active layer. Examples of dyes, chromogenic materials, and inert pigments include fluorescent, organic and inorganic pigments. These compounds may lead to black-white printing or color printing. Examples of developers include acidic developers such as acidic phenolic compounds and aromatic carboxylic acids. Examples of sensitizers include ether compounds such as aromatic ether compounds. One or more of any of the active layer components may or may not be microencapsulated.

The active layer is of sufficient basis weight to provide a visible, detectable and/or desirable image on the thermal paper for an end user. In one embodiment, the active layer has a basis weight of about 1.5 $g/m^2$ or more and about 7.5 $g/m^2$ or less. In another embodiment, the active layer has a basis weight of about 3 $g/m^2$ or more and about 30 $g/m^2$ or less. In yet another embodiment, the active layer has a basis weight of about 5 $g/m^2$ or more and about 15 $g/m^2$ or less. In still yet another embodiment, the active layer has a thickness of about 1 micron or more and about 30 microns or less. In another embodiment, the active layer has a thickness of about 5 microns or more and about 20 microns or less.

One of the advantages of the subject invention is that a smaller active layer (or less active layer components) is required in thermal paper of the invention compared to thermal paper that does not contain a base layer having specified thermal effusivity properties as described herein. Since the active layer of thermal paper typically contains the most expensive components of the thermal paper, decreasing the size of the active layer is a significant advantage associated with making the subject thermal paper.

The base layer contains a binder and a porosity improver and has a specified thermal effusivity as described herein. The base layer may further and optionally contain a dispersant, wetting agent, and other additives, so long as the thermal effusivity values are maintained. In one embodiment, the base layer does not contain image forming components; that is, the base layer does not contain any of a dye, chromogenic material, and/or organic and inorganic pigments.

The base layer contains a sufficient amount of binder to hold the porosity improver. In one embodiment, the base layer contains about 5% by weight or more and about 95% by weight or less of binder. In another embodiment, the base layer contains about 15% by weight or more and about 90% by weight or less of binder.

Examples of binders include water-soluble binders such as starches, hydroxyethyl cellulose, methyl cellulose, carboxymethyl cellulose, gelatin, casein, polyvinyl alcohol, modified polyvinyl alcohol, sodium polyacrylate, acrylic amide/acrylic ester copolymer, acrylic amide/acrylic ester/methacrylic acid terpolymer, alkali salts of styrene/maleic anhydride copolymer, alkali salts of ethylene/maleic anhydride copolymer, polyvinyl acetate, polyurethane, polyacrylic esters, styrene/butadiene copolymer, acrylontrile/butadiene copolymer, methyl acrylate/butadiene copolymer, ethylene/vinyl acetate copolymer, and the like. Further examples of binders include polyester resin, vinyl chloride resin, polyurethane resin, vinyl chloride-vinyl acetate copolymer, vinyl chlorideacrylonitrile copolymer, epoxy resin, nitrocellulose, and the like.

The porosity improver of the subject invention has at least one of high surface area, high pore volume, narrow particle size distribution, and/or high porosity when assembled in a layer (and thus appear to possess a high pore volume). Examples of the porosity improver include one or more of calcined clays such as calcined kaolin, flash calcined kaolin, and calcined bentonite, acid treated bentonite, high surface area alumina, hydrated alumina, boehmite, flash calcined alumina trihydrate (ATH), silica, silica gel, zeolites, zeotypes and other molecular sieves, clathrasils, micro-, meso- and macro-porous particles, alumina phosphates, metal alumina phosphates, mica, pillared clays and the like. These compounds are commercially available through a number of sources.

The base layer may contain at least one porosity improver, at least two porosity improvers, at least three porosity improvers, and so on. The porosity improver contributes to the desirable thermal effusivity properties of the base layer. In one embodiment where at least two porosity improvers are included in the base layer, one porosity improver is a calcined clay such as calcined kaolin and the other porosity improver is one of an acid treated bentonite, high surface area alumina, hydrated alumina, flash calcined kaolin, flash calcined ATH, silica, silica gel, zeolite, micro-, meso- or macro-porous particle, alumina phosphate, molecular sieve, clathrasils, pillared clay, boehmite, mica or metal alumina phosphate.

Other useful porosity improvers include zeolites. Zeolites and/or zeotypes, frequently also referred to as molecular sieves, are a class of micro- and mesoporous materials with 1, 2 or 3-D pore system and with a variety of compositions including silica, aluminosilicates (natural and traditional synthetic zeolites), alumino-phosphates (ALPO's), silicon-aluminophosphates (SAPO's) and many others. One of the key properties of these materials is that they (in many cases) reversibly adsorb and desorb large quantities of structural water, and if they are stable in their dehydrated state, they will also reversibly adsorb and desorb other gases and vapors. This is possible because of the micro- and mesoporous nature of their structure.

The porosity in zeolites can be best described in terms of channels or cages connected by smaller windows. Depending on if and how these intersect, they create 1-, 2- or 3-dimensional pore system with pore diameters and pore openings ranging in size from about 2.5 angstroms to more than 100 angstroms. As a result, they contain a non-negligible amount of pore volume in their structures and their densities are lower than those of their non-porous or dense polymorphs. In some instances they can be at least 50% less dense. The amount of porosity is most commonly described in terms of pore volume (cc/g), or framework density (FD). The reference FD of dense silica structure (quartz) is approximately 26.5. Table 1 shows examples of some of the most common structures including their pore characteristics.

TABLE 1

| Property Zeolite | Pore volume (cc/g) | FD (T/1000 Å$^3$) | Pore size (Å) | Type of channels |
|---|---|---|---|---|
| Analcime | 0.18 | 18.5 | 2.6 | 1-D |
| ZSM-4 | 0.14 | 16.1 | 7.4 | 3-D |
| Ferrierite | 0.28 | 17.6 | 4.8 | 2-D |
| Sodalite | 0.35 | 17.2 | 2.2 | 3-D |
| Zeolite A | 0.47 | 12.7 | 4.2 | 3-D |
| Zeolite X | 0.50 | 13.1 | 7.4 | 3-D |

For the porosity improvers other than calcined clays, the porosity improver of the subject invention has one or more of at least about 70% by weight of the particles have a size of 2 microns or less, at least about 50% by weight of the particles have a size of 1 micron or less, a surface area of at least about 10 m$^2$/g, and a pore volume of at least about 0.1 cc/g. In another embodiment, the porosity improver of the subject invention (other than calcined clays) has one or more of at least about 80% by weight of the particles have a size of 2 microns or less, at least about 60% by weight of the particles have a size of 1 micron or less, a surface area of at least about 15 m$^2$/g, and a pore volume of at least about 0.2 cc/g. In yet another embodiment, the porosity improver of the subject invention (other than calcined clays) has one or more of at least about 90% by weight of the particles have a size of 2 microns or less, at least about 70% by weight of the particles have a size of 1 micron or less, a surface area of at least about 20 m$^2$/g, and a pore volume of at least about 0.3 cc/g.

Calcining destroys the crystallinity of hydrous kaolin or bentonite, and renders the kaolin/clay substantially amorphous. Calcination typically occurs after heating at temperatures in the range from about 700 to about 1200° C. for a sufficient period of time. Commercial vertical and horizontal rotary calciners can be used to produce metakaolin, partially calcined kaolin, and/or calcined kaolin. Acid treatment involves contacting clay with an amount of a mineral acid to render the clay substantially amorphous.

In one embodiment, calcined clay of the subject invention has one or more of at least about 70% by weight of the particles have a size of 2 microns or less, at least about 50% by weight of the particles have a size of 1 micron or less, a surface area of at least about 5 m$^2$/g, and a pore volume of at least about 0.1 cc/g. In yet another embodiment, calcined clay of the subject invention has one or more of at least about 80% by weight of the particles have a size of 2 microns or less, at least about 60% by weight of the particles have a size of 1 micron or less, a surface area of at least about 10 m$^2$/g, and a pore volume of at least about 0.2 cc/g. In still yet another embodiment, calcined clay of the subject invention has one or more of at least about 90% by weight of the particles have a size of 2 microns or less, at least about 70% by weight of the particles have a size of 1 micron or less, a surface area of at least about 15 m$^2$/g, and a pore volume of at least about 0.3 cc/g.

As noted the non-calcined clay porosity improver or the calcined clay porosity improver may have a pore volume of at least about 0.1 cc/g, at least about 0.2 cc/g, or at least about 0.3 cc/g. Alternatively, the non-calcined clay porosity improver or the calcined clay porosity improver may have an equivalent pore volume of at least about 0.1 cc/g, at least about 0.2 cc/g, or at least about 0.3 cc/g. In this connection, while the individual porosity improver particles may not have the required pore volume, when assembled in a layer, the porosity improver particles may form a resultant structure (base layer) that is porous, and has the porosity as if the layer was made of a porosity improver having a pore volume of at least about 0.1 cc/g, at least about 0.2 cc/g, or at least about 0.3 cc/g. That is, the base layer may having a pore volume of at least about 0.1 cc/g, at least about 0.2 cc/g, or at least about 0.3 cc/g. Thus, the porosity improver may be porous in and of itself, or it may enhance the porosity of the base layer.

Surface area is determined by the art recognized BET method using $N_2$ as the adsorbate. Surface area alternatively is determined using Gardner Coleman Oil Absorption Test and is based on ASTM D-1483-84 which measures grams of oil absorbed per 100 grams of kaolin. Pore volume or porosity is measured by standard Mercury Porosimetry techniques.

All particle sizes referred to herein are determined by a conventional sedimentation technique using a Micromeritics, Inc.'s SEDIGRAPH® 5100 analyzer. The sizes, in microns, are reported as "e.s.d." (equivalent spherical diameter). Particles are slurried in water with a dispersant and pumped through the detector with agitation to disperse loose agglomerates.

Examples of commercially available calcined clay of the subject invention include those under the trade designations such as Ansilex® such as Ansilex® 93, Satintone®, and Translink®, available from Engelhard Corporation of Iselin, N.J.

The base layer contains a sufficient amount of a porosity improver to contribute to providing insulating properties, such as a beneficial thermal effusivity, that facilitate high quality image formation in the active layer. In one embodiment, the base layer contains about 5% by weight or more and about 95% by weight or less of a porosity improver. In another embodiment, the base layer contains about 15% by weight or more and about 90% by weight or less of a porosity improver. In yet another embodiment, the base layer contains about 15% by weight or more and about 40% by weight or less of a porosity improver.

The base layer is of sufficient basis weight to provide insulating properties, such as a beneficial thermal effusivity, that facilitate high quality image formation in the active layer. In one embodiment, the base layer has a basis weight of about 1 g/m$^2$ or more and about 50 g/m$^2$ or less. In another embodiment, the base layer has a basis weight of about 3 g/m$^2$ or more and about 40 g/m$^2$ or less. In yet another embodiment, the base layer has a basis weight of about 5 g/m$^2$ or more and about 30 g/m$^2$ or less. In still yet another embodiment, the base layer has a basis weight of about 7 g/m$^2$ or more and about 20 g/m$^2$ or less. In another embodiment, the base layer has a thickness of about 0.5 microns or more and about 20 microns or less. In yet another embodiment, the base layer has a thickness of about 1 micron or more and about 10 microns or less. In another embodiment, the base layer has a thickness of about 2 microns or more and about 7 microns or less.

Another beneficial aspect of the base layer is the thickness uniformity achieved when formed across the substrate layer. In this connection, the thickness of the base layer does not vary by more than about twenty percent when selecting two random locations of the base layer for determining thickness.

Each of the layers or coatings is applied to the thermal paper substrate by any suitable method, including coating optionally with a doctor blade, rollers, air knife, spraying, extruding, laminating, printing, pressing, and the like.

The thermal paper of the subject invention has one or more of the improved properties of less active layer material required, enhanced image intensity, enhanced image density, improved base layer coating rheology, lower abrasion characteristics, and improved thermal response. The porosity improver functions as a thermal insulator thereby facilitating reaction between the image forming components of the active layer providing a more intense, crisp image at lowered temperatures and/or faster imaging. That is, the porosity improver functions to improve the heat insulating properties in the thermal paper thereby improving the efficiency of the active layer in forming an image.

For thermal paper, thermal sensitivity is defined as the temperature at which the active layer of thermal paper produces an image of satisfactory intensity. Background is defined as the amount of shade/coloration of thermal paper before imaging and/or in the unimaged areas of imaged thermal paper. The ability to maintain the thermal sensitivity of thermal paper while reducing the background shade/coloration is significant advantage of the subject invention. Beneficial increases in thermal response in the active layer of thermal paper are achieved through the incorporation of a porosity improver as described herein in the base layer.

Comparing thermal papers with similar components, except that one (thermal of the subject invention) has at least one porosity improver in the base layer, the thermal paper precursor of the subject invention has a thermal effusivity value that is about 2% less than the thermal effusivity of porosity improver-less thermal paper composite precursor. The 2% includes a standard deviation of about 0.5-1% observed in effusivity measurements of precursor sheets. In another embodiment, the thermal paper precursor of the subject invention has a thermal effusivity value that is about 5% less than the thermal effusivity of porosity improver-less thermal paper composite precursor. In another embodiment, the thermal paper precursor of the subject invention has a thermal effusivity value that is about 15% less than the thermal effusivity of porosity improver-less thermal paper composite precursor.

Thermal effusivity is a comprehensive measure for heat distribution across a given material. Thermal effusivity characterizes the thermal impedance of matter (its ability to exchange thermal energy with surroundings). Specifically, thermal effusivity is a function of the density, heat capacity, and thermal conductivity. Thermal effusivity can be calculated by taking the square root of thermal conductivity (W/mK) times the density ($kg/m^3$) times heat capacity (J/kgK). Thermal effusivity is a heat transfer property that dictates the interfacial temperature when two semi-infinite objects at different temperature touch.

Thermal effusivity can be determined employing a Mathis Instruments TC-30 Thermal Conductivity Probe using a modified hot wire technique, operating under constant current conditions. The temperature of the heating element is monitored during sample testing, and changes in the temperature at the interface between the probe and sample surface, over the testing time, are continually measured.

In one embodiment, the thermal effusivity ($Ws^{1/2}/m^2K$) of the substrate coated with base layer is about 450 or less. In another embodiment, the thermal effusivity of the substrate coated with base layer is about 370 or less. In yet another embodiment, the thermal effusivity of the substrate coated with base layer is about 330 or less. In still yet another embodiment, the thermal effusivity of the substrate coated with base layer is about 300 or less.

The subject invention can be further understood in connection with the drawings. Referring to FIG. 1, a cross sectional view of a three layer construction of thermal paper 100 is shown. A substrate layer 102 typically contains a sheet of paper. On one side (the writing side or image side) of the substrate layer 102 is a base layer 104. The combination of substrate layer 102 and the base layer 104 is an example of the present thermal paper composite precursor.

The thermal paper composite precursor can be combined with an active layer 106 so that the base layer 104 is positioned between the substrate layer 102 and the active layer 106. This combination is an example of a thermal paper composite precursor. The base layer 104 contains a porosity improver in a binder and provides thermal insulating properties and prevents the transfer of thermal energy emanating from a thermal print head through the active layer 106 to the substrate layer 102 during the writing or imaging process. The base layer 104 also prevents the active layer 106 materials from weeping into the substrate layer 102. The active layer 106 contains components that form an image in specific locations in response to the discrete delivery of heat or infrared radiation from the thermal print head.

Figure 2:
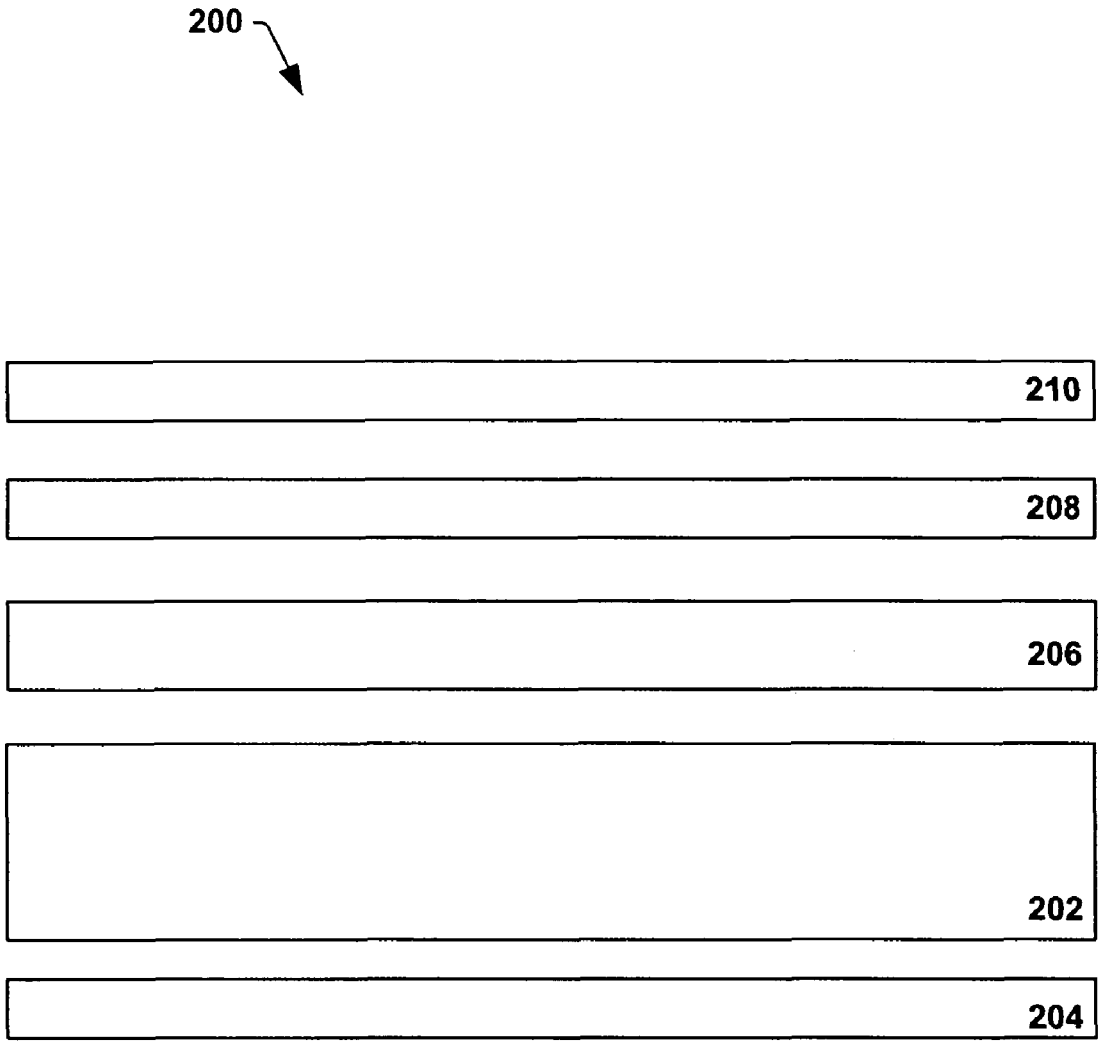
FIG. 2 is a cross sectional illustration of thermal paper in accordance with another aspect of the subject invention.

Referring to FIG. 2, a cross sectional view of a five layer construction of thermal paper 200 is shown. A substrate layer 202 contains a sheet of paper. On one side (the non-writing side or backside) of the substrate layer 202 is a backside barrier 204. The backside barrier 204 in some instances provides additional strength to the substrate layer 202 as well as prevents contamination of the substrate layer 202 that may creep to the writing side. On the other side (the writing side or image side) of the substrate layer 202 is a base layer 206, an active layer 208, and a protective coat 210. The combination of substrate layer 202 and the base layer 206 is an example of the present thermal paper composite precursor. The base layer 206 is positioned between the substrate layer 202 and the active layer 208. The base layer 206 contains a porosity improver in a binder and provides thermal insulating properties and prevents the transfer of thermal energy emanating from a thermal print head through the active layer 208 and protective coat 210 to the substrate layer 202 during the writing or imaging process. The active layer 208 contains components that form an image in specific locations in response to the discrete delivery of heat or infrared radiation from the thermal print head. The protective coat 210 is transparent to the subsequently formed image, and prevents loss of active layer 208 components due to abrasion with the thermal paper 200.

Although not shown in the figures, the thermal paper structures may contain additional layers, and/or the thermal paper structures may contain additional base and active layers for specific applications. For example, the thermal paper structures may contain a base layer, optionally a backside barrier, three base layers alternating with three active layers, and a protective coating.

Figure 3:
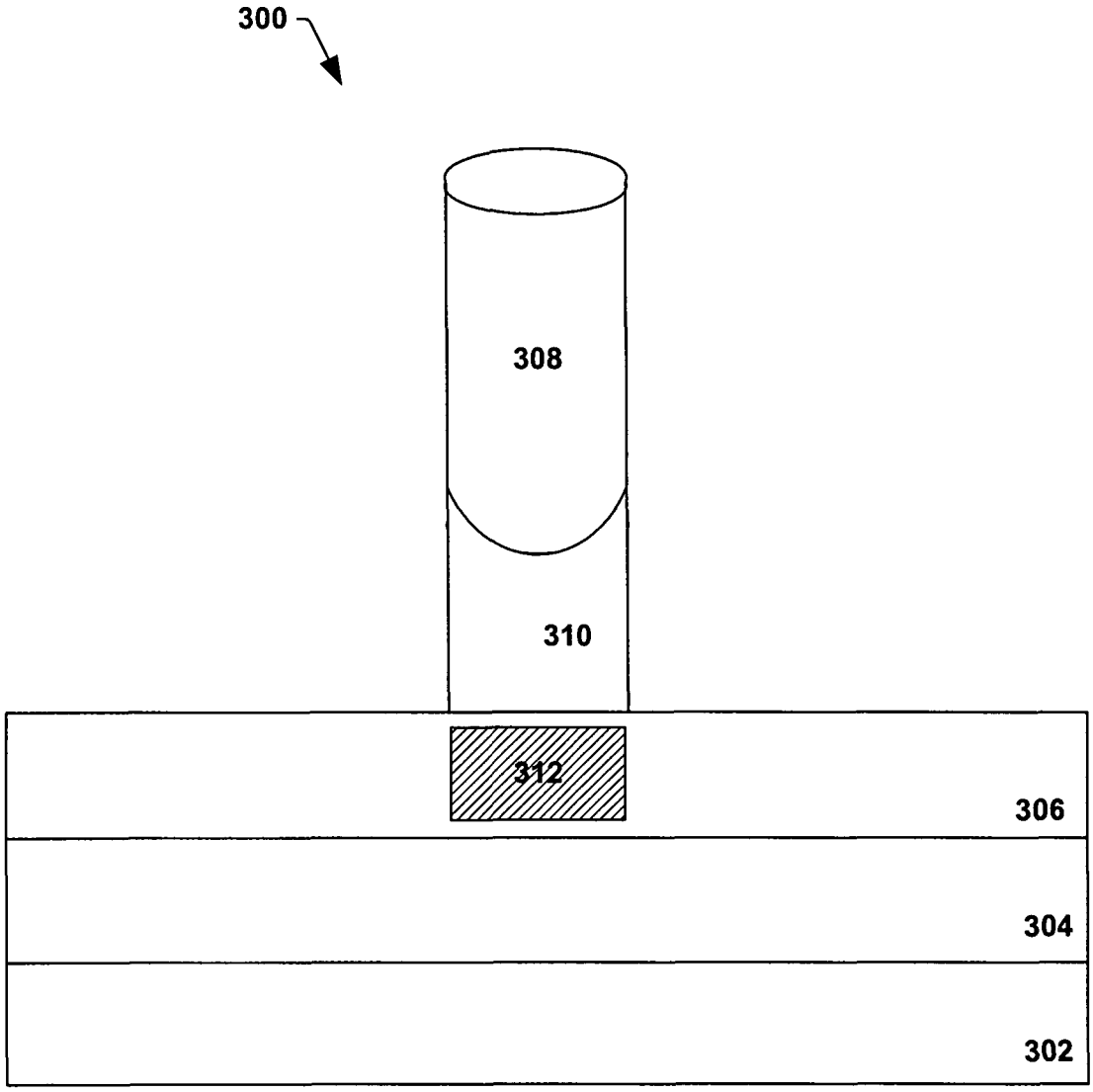
FIG. 3 is a cross sectional illustration of a method of forming an image in thermal paper in accordance with an aspect of the subject invention.

Referring to FIG. 3, a cross sectional view of a method 300 of imaging thermal paper is shown. Thermal paper containing a substrate layer 302, a base layer 304 and an active layer 306 is subjected to a writing process. A thermal print head 308 from a writing machine (not shown) is positioned near or in close proximity to the side of the thermal paper having the active layer 306. In some instances the thermal print head 308 may contact the thermal paper. Heat 310 is emitted, and the heat generates, induces, or otherwise causes and image 312 to appear in the active layer 306. The temperature of the heat applied or required depends upon a number of factors including the identity of the image forming components in the active layer. Since the base layer 304 is positioned between the substrate layer 302 and the active layer 306, the base layer 304 mitigates the transfer of thermal energy from the thermal print head 308 through the active layer 306 to the substrate layer 302 owing to its desirable thermal effusivity and thermal insulating properties.

Thermal effusivity test method: Thermal properties of materials can be characterized by a number of characteristics, such as thermal conductivity, thermal diffusivity and thermal effusivity. Thermal conductivity is a measure of the ability of material to conduct heat (W/mK). Thermal diffusivity measures the ability of a material to conduct thermal energy relative to its ability to store energy ($mm^2/s$). Thermal effusivity is defined as the square root of the product of thermal conductivity (k), density (ρ) and heat capacity (cp) of a material ($Ws^{1/2}/m^2K$).

Thermal insulating properties of the pigments of current invention were characterized using Mathis Instruments TC-30 direct thermal conductivity instrument, by measuring thermal effusivities of coated substrates. No active coat was applied. Substrates were typically coated with 5-10 $g/m^2$ of base layer containing the pigment, and then calendered to about the same smoothness of approximately 2 microns as determined by Print-Parker-Surf (PPS) roughness test. A sheet of the coated substrate was then cut into pieces large enough to cover the TC-30 detector. Although the orientation of the base coat with respect to the sensor (if kept constant), is not crucial for obtaining useful data, orientation "towards the sensor" (as opposed to "away from the sensor") is preferred and was used. To ensure that the heat wave does not penetrate the sample, about 5-10 pieces of coated substrate were layered in the test to increase the useful sample cross section. For each pigment, approximately 100 measurements were performed with optimized test times, regression start times and cool times, and to maximize the base-layer coat area subject to measurement, the bottom piece was removed and placed on top of the stack every 12 measurements. This also significantly improved precision of the measurement. Since any air pockets in-between the layers due to non-uniform surface roughness will have negative impact on accuracy and precision of the effusivity measurements, calendering is a very important step in the sample preparation. Any differences in effusivities greater then the standard deviation of respective measurements, typically 0.5-1%, can be considered real.

As thermal effusivity values of substrates coated with base layer can vary depending on many parameters, including the base-layer coat weight and its formulation, nature of the substrate, temperature and humidity during measurement, calendering conditions, smoothness of the tested papers, instrument calibration etc., it is best to evaluate and rank pigments and their thermal properties on a comparative basis vs. control (does not contain porosity improver) rather than by using their absolute measured effusivity values.

INVENTIVE EXAMPLE 1

Two pigments coated as a base coat on a substrate layer and also coated with commercial active layer coat were evaluated for thermal effusivity and image quality, respectively, to illustrate the importance of the thermal insulating properties of the base coat on the image quality—both optical density and visual quality/uniformity. One of the pigments was a commercially available synthetic pigment—"Synthetic pigment", the other was a 100% calcined kaolin pigment". Active coats on both papers were developed by placing 3×3 inch squares of each paper into an oven set to 100° C. for 2 min. Thermal effusivities of substrate/base coat composites and their corresponding image quality evaluations are summarized in Table 2. The synthetic pigment gave lower effusivity and had higher optical density. Visually, it looked black and had very good image uniformity. Sample coated with calcined kaolin pigment showed higher effusivity and lower optical density. In visual evaluations, this sample looked gray with highly non-uniform appearance. Overall, the data indicate an inverse relationship between the thermal effusivity of the thermal paper precursor and the optical density of the finished thermal paper. Visual evaluation also shows better image quality for lower effusivity pigment.

TABLE 2

| Pigment | Effusivity ($Ws^{1/2}/m^2K$) | Optical density (on full print sheet) | Image visual quality: Darkness | Image visual quality: Uniformity |
|---|---|---|---|---|
| Calcined kaolin | 384 | 0.86 | gray | Poor |
| Synthetic pigment | 370 | 1.08 | black | very good |

INVENTIVE EXAMPLE 2

Two pigments were prepared, coated on a thermal base paper, calendered to about the same PPS roughness of approximately 2 μm and evaluated for thermal effusivity. Thermal effusivities were measured on base paper/base coat composites at about 22° C. and about 40% RH using Mathis Instruments TC-30 thermal conductivity/effusivity analyzer.

These composite thermal paper precursor sheets were then coated with a commercial active coat and evaluated using industry standard instrumentation for half energy optical density. The pigments included commercial standard calcined kaolin and hydrous kaolin treated with sodium silicate (20 lbs/ton clay). Physical characteristics of these pigments and their coatings are summarized in Table 3. The hydrous kaolin treated with sodium silicate is referred to as treated hydrous kaolin in the remainder of this Inventive Example 2.

TABLE 3

| Pigment | Particle Size Distribution: Median (μm) | Particle Size Distribution: % < 2 μm | Particle Size Distribution: % < 1 μm | Surface area ($m^2/g$) | Oil adsorption (g/100 g) | Coat weight ($g/m^2$) |
|---|---|---|---|---|---|---|
| Calcined Kaolin | 0.84 | 87 | 62 | 13.4 | 89 | 7.6 |
| Treated Hydrous Kaolin | 0.55 | 84 | 70 | 18.7 | 47 | 7.6 |

Results of effusivity measurements of the composite precursor sheets and their optical density values at half energy are listed in Table 4.

TABLE 4

| Pigment | Effusivity ($Ws^{1/2}/m^2K$) | Optical density |
|---|---|---|
| Calcined Kaolin | 349 | 1.31 |
| Treated Hydrous Kaolin | 368 | 1.21 |

Thermal effusivity of the calcined kaolin containing precursor was more than 5% lower than that of the treated hydrous kaolin. This lowered effusivity, as expected, provided improved print quality as measured by higher optical densities. The calcined kaolin showed about 8% improvement in optical density compared to the treated hydrous kaolin. In the case of treated hydrous kaolin, thermal effusivity of the thermal paper precursor was higher than that of calcined kaolin, which in turn yielded worse optical density. One can conclude that lower thermal effusivity of the base coat layer, and thus of the thermal paper composite precursor, has a positive effect on the image quality of the final thermal paper.

INVENTIVE EXAMPLE 3

To illustrate the effect of porosity in the base coat on the thermal effusivity of the thermal paper precursor, four pigments were prepared, coated on a thermal base paper, calendered to about the same PPS roughness of approximately 2 μm and evaluated for thermal effusivity using Mathis Instruments TC-30 analyzer. The pigments included commercial calcined kaolin, blend of 80 parts of commercial calcined kaolin and 20 parts of commercially available silica zeolite Y—"80 kaolin/20 silica Y", blend of 90 parts of commercial calcined kaolin and 10 parts of Engelhard made zeolite Y—"90 kaolin/10 zeolite Y" and hydrous kaolin treated with sodium silicate (20 lbs/ton clay)—"treated hydrous kaolin". The effusivities were measured on base paper/base coat composites at about 22° C. and about 40% RH; the pore volumes in the base coat layers were obtained from mercury porosimetry. Physical characteristics of these pigments and their coatings are summarized in Table 5.

TABLE 5

| | Particle Size Distribution | | | Surface | Oil adsorption | Coat |
|---|---|---|---|---|---|---|
| Pigment | Median (μm) | % < 2 μm | % < 1 μm | area ($m^2/g$) | (g/100 g) | weight ($g/m^2$) |
| Treated Hydrous Kaolin | 0.55 | 84 | 70 | 18.7 | 47 | 7.6 |
| Calcined Kaolin | 0.84 | 87 | 62 | 13.4 | 89 | 7.6 |
| 80 Kaolin/20 silicaY | 0.77 | 89 | 66 | 155.2 | 93 | 7.5 |
| 90 Kaolin/10 zeoliteY | 0.81 | 86 | 63 | 25.1 | 75 | 7.5 |

Effusivity measurements of the composite sheets and pore volumes in their respective base coat layers are presented in Table 6.

TABLE 6

| Pigment | Effusivity ($Ws^{1/2}/m^2K$) | Pore volume* (cc/g) |
|---|---|---|
| Treated Hydrous Kaolin | 368 | 0.170 |
| Calcined Kaolin | 349 | 0.205 |
| 80 Kaolin/20 silicaY | 328 | 0.223 |
| 90 Kaolin/10 zeoliteY | 316 | 0.225 |

*in Table 6 means that the porosity of the base layer coated on the substrate in the 20-10000 Å range Results show that the thermal effusivity of the composite precursor is inversely proportional to the pore volume in the base coat layer i.e. that the composite sheet with the highest thermal effusivity has the lowest pore volume, and the composite with the lowest effusivity contains highest pore volume. This also shows that the presence of a porosity improver in the base coat layer has a positive effect on its thermal properties, such that it reduces the thermal effusivity of the thermal paper composite precursor when compared to the same that does not contain a porosity improver. One can conclude that, a precursor containing a porosity improver and having an increased pore volume in the base coat will posses lower thermal effusivity and thus will result in improved image quality of the finished thermal paper.

INVENTIVE EXAMPLE 4

Two pigments were prepared and tested to demonstrate positive benefit of increased base coat layer porosity on thermal effusivity of the thermal paper precursor and on image quality of the finished thermal paper. One pigment was a hydrous kaolin calcined to mullite index of 35-55—"Calcined clay", the second pigment was a blend of 80 parts of commercial calcined kaolin and 20 parts of commercially available silica zeolite Y—"80 kaolin/20 silica Y". Both pigments were coated on a commercial thermal base paper, calendered to approximately the same PPS roughness of about 2 μm, and evaluated for pore volumes and thermal effusivities. Both effusivities and pore volumes were measured on respective thermal paper precursor sheets. The sheets were also treated with a commercial active coat layer and tested using industry standard instrumentation (Atlantek 200) for image density. Basic physical characteristics of both pigments and their base coatings are summarized in Table 7.

TABLE 7

| | Particle Size Distribution | | | Surface | Oil adsorption | Coat |
|---|---|---|---|---|---|---|
| Pigment | Median (μm) | % < 2 μm | % < 1 μm | area ($m^2/g$) | (g/100 g) | weight ($g/m^2$) |
| Calcined clay | 1.01 | 82 | 49 | 10.8 | 90 | 7.7 |
| 80 kaolin/20 silicaY | 0.77 | 89 | 66 | 155.2 | 93 | 7.5 |

Results of effusivity measurements of the composite precursor sheets and their image density values at half energy (~7 $mJ/mm^2$) are presented in Table 8.

TABLE 8

| Pigment | Pore volume* (cc/g) | Effusivity ($Ws^{1/2}/m^2K$) | Image density |
|---|---|---|---|
| Calcined clay | 0.212 | 383 | 0.48 |
| 80 Kaolin/20 silicaY | 0.223 | 365 | 0.63 |

*porosity of the base layer coated on the substrate in the 20-10000 Å range

The pore volume of the blended pigment was more than 5% higher than that of the calcined clay. This increased porosity of the blended pigment base coat in turn positively affected thermal effusivity of the full precursor, which was about 5% lower compared to the calcined clay containing precursor. Most importantly, the image density of the blended pigment containing thermal paper was significantly improved. These results clearly show the benefit of the porosity improver in the base coat, its positive effect on the thermal effusivity of the precursor and its strong positive impact on image quality of the finished thermal paper.

While the invention has been explained in relation to certain embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. Thermal paper composite comprising:

(1) an active layer containing image forming components; and (2) a thermal paper composite precursor comprising a) a substrate layer; and (b) a base layer positioned on the substrate layer, the base layer comprising a binder, calcined kaolin, and at least one porosity improver, wherein said thermal paper composite precursor has a thermal effusivity that is at least about 2% less than the thermal effusivity of porosity improver-less thermal paper composite precursor, wherein said calcined kaolin in said base layer has at least one of: at least about 70% by weight of the particles having a size of 2 microns or less, at least about 50% by weight of the particles have a size of 1 micron or less, a surface area of at least about 5 $m^2/g$, and a pore volume of at least about 0.1 cc/g, wherein if said at least one porosity improver is not a calcined clay then said at least one porosity improver has at least one of: at least about 70% by weight of the particles have a size of 2 microns or less, at least about 50% by weight of the particles have a size of 1 micron or less, a surface area of at least about 10 $m^2/g$, and a pore volume of at least about 0.1 cc/g; and if said at least one porosity improver is a calcined clay then said at least one porosity improver has at least one of: at least about 70% by weight of the particles having a size of 2 microns or less, at least about 50% by weight of the particles have a size of 1 micron or less, a surface area of at least about 5 $m^2/g$, and a pore volume of at least about 0.1 cc/g.

2. The thermal paper of claim 1 wherein said at least one porosity improver in said base layer is calcined bentonite.

3. The thermal paper of claim 1 wherein said at least one porosity improver in said base layer is selected from the group consisting of silica, silica gel, and zeolite.

4. The thermal paper of claim 1 wherein said thermal paper composite precursor has a thermal effusivity that is at least about 5% less than the effusivity of porosity improver-less thermal composite precursor.

5. The thermal paper of claim 1 wherein said thermal paper composite precursor has a thermal effusivity that is at least about 10% less than the effusivity of porosity improver-less thermal composite precursor.

6. The thermal paper of claim 1 wherein said thermal paper composite precursor has a thermal effusivity that is at least about 15% less than the effusivity of porosity improver-less thermal composite precursor.

7. The thermal paper of claim 1 wherein said at least one porosity improver is silica.

8. The thermal paper of claim 1 wherein said at least one porosity improver is zeolite.

9. The thermal paper composite of claim 1 wherein said at least one porosity improver is selected from the group consisting of flash calcined kaolin, calcined bentonite, acid treated bentonite, high surface area alumina, hydrated alumina, boehmite, flash calcined alumina trihydrate, silica, silica gel, zeolite, zeotypes, non-zeotype molecular sieves, clathrasils, macroporous particles, mesoporous particles, macroporous particles, alumina phosphates, metal alumina phosphates, mica, and pillared clays.

10. The thermal paper composite of claim 1, wherein the pore volume of the base layer is between 0.170 cc/g and 0.225 cc/g.

11. The thermal paper composite of claim 1, wherein said at least one porosity improver is selected from the group consisting of silica and zeolite, and wherein the pore volume of the base layer is about 0.225 cc/g.

* * * * *